United States Patent [19]

Grenz et al.

[11] Patent Number: 4,930,715

[45] Date of Patent: Jun. 5, 1990

[54] ROTARY BASKET WINDER WITH WATER COOLING

[75] Inventors: Günter Grenz, Meerbusch; Werner Kohlstedde, Hilden, both of Fed. Rep. of Germany

[73] Assignee: SMS Schloemann-Siemag Aktiengesellschaft, Dusseldorf, Fed. Rep. of Germany

[21] Appl. No.: 300,481

[22] Filed: Jan. 23, 1989

[30] Foreign Application Priority Data

Jan. 20, 1988 [DE] Fed. Rep. of Germany ..... 3801465

[51] Int. Cl.[5] ..... B21C 47/00; C21D 1/62

[52] U.S. Cl. ..... 242/83; 266/112

[58] Field of Search ..... 242/82, 83, 84; 266/112

[56] References Cited

U.S. PATENT DOCUMENTS

| | | | |
|---|---|---|---|
| 854,810 | 5/1907 | Daniels | 242/83 |
| 1,977,989 | 10/1934 | Gassen | 242/83 |
| 3,128,961 | 4/1964 | Wickwire | 242/82 |
| 3,604,691 | 9/1971 | Sherwood | 266/112 |
| 4,172,375 | 10/1979 | Rushforth et al. | 266/112 X |
| 4,569,220 | 2/1986 | Hopfe et al. | 73/3 |

FOREIGN PATENT DOCUMENTS

| | | | |
|---|---|---|---|
| 3417323 | 11/1985 | Fed. Rep. of Germany | 242/83 |
| 965972 | 8/1964 | United Kingdom | 242/83 |

*Primary Examiner*—Stuart S. Levy
*Assistant Examiner*—Eric P. Dunlap
*Attorney, Agent, or Firm*—Toren, McGeady & Associates

[57] ABSTRACT

A rotary basket winder with water cooling for winding a material includes a tank in the shape of an open topped point containing a rotatable winding carrier with two upwardly extending concentrically arranged rings of winding rods defining an annular winding space between them. A stationary guide pipe leads material into the winding space. A winding disk can be raised and lowered within the tank. Previously, in rotary winding baskets, the problem has been to effect uniform cooling, particularly in the center of the winding basket because of the formation of a funnel, and to afford trouble-free annular delivery after the winding process with high-strength work material characteristics. In the present rotary basket winder, coolant openings are located in the upper part of the tank and are arranged to recirculate a sufficient quantity of coolant into the center of the tank from above. In addition, rigid pins are mounted on the tank above the winding rods of the outer ring and form a ring with an inside diameter equal approximately to the inside diameter of the outer ring. Preferably, these pins are radially adjustable. Further, the winding rods of the inner ring have a length corresponding approximately to the height of the coolant level in the center of the inner ring.

6 Claims, 3 Drawing Sheets

ROTARY BASKET WINDER WITH WATER COOLING

BACKGROUND OF THE INVENTION

The present invention is directed to a rotary basket winder with water cooling for the material to be wound. The winder includes a rotary winding disk with two concentrically arranged rings of winding rods and a stationary guide pipe for directing material into the space between the concentric rings. The winding disk is arranged so that it can be raised and lowered in the tank of the winder for delivering the material in a ring or annular shape. The tank is pot shaped with an open top and a closed bottom. The tank holds the coolant for the winder. A drive shaft for the winding rods extends through the bottom of the tank and a seal is provided for the shaft. A coolant can be filled into the tank up to a level above the winding rings. The coolant can be directed into the tank from above and from the sides at different vertically spaced locations. Such rotary basket winders, suitable for use in wet or dry operation, generally operate in a reliable manner. Auxiliary operating personnel are not required.

A rotary basket winder for winding rings of material, suitable for small batches and usable for wet or dry winding, is disclosed in German Offenlegungsschrift No. DE-A-34 17 323. In winding work material of high strength characteristics or high grade steels into rings, there is the problem of positioning the steel rod ends or the leading and trailing ends of material to be wound, since the ends spring outwardly when the winding disk is lifted and interfere with the removal of the material from the cooling tank and during further transportation.

In addition, uniform cooling of the material being wound in the upper portion of the tank is not assured in the known so-called Garrett winder, since a paraboloidal funnel is formed in the center of the inner winding ring, due to the presence of high centrifugal forces. As a result, cooling conditions vary sharply from place to place with a disadvantageous effect on the quality of the material being wound. During dry operation, similar problems exist in the required cooling of the outer winding ring and of the winding disk and the winding carrier.

SUMMARY OF THE INVENTION

Therefore, it is the primary object of the present invention to provide a rotary basket winder in which the above disadvantages can be avoided and the problems eliminated. In particular, the rotary basket winder of the present invention insures a trouble-free removal of the wound material from the basket winder and provides the material in a ring shape which enables a trouble-free transporting and binding process. Moreover, the features for improving the dry winding operation do not have any negative influence on the wet winding operation.

In accordance with the present invention, coolant outlet openings are located in the upper part of the tank and are dimensioned or are adjustable so that an adequate quantity of coolant water can be recirculated to the center of the inner winding ring and the basket winder from above. Due to this arrangement, in accordance with the invention, during the rotation of the basket winder, an almost horizontal turbulent water surface is developed with only a slight funnel formation which serves to insure uniform and complete material cooling and cooling of the winding rings during the winding operation. According to a preferred construction of the invention, rigid pins are arranged above the rods of the outer winding ring within the cooling tank and form a ring with an inside diameter approximately equal to the inside diameter of the outer ring. Preferably, the pins are arranged to be radially adjustable. Coolant water is guided back into the tank through the open spaces between the stationary pins, adjustable in the radial direction, and such pins at the same time assume the task of guiding and securing the winding base in its rotational position during the removal of the wound ring by lifting the winding disk.

In a particularly advantageous manner, the rods of the inner winding ring have a length corresponding approximately to the desired level of the coolant in the center of the inner ring. In this manner, the cooling conditions are optimized and the guidance of the material being wound is improved at the same time.

In another embodiment, perforated plate strips are arranged between the rods of the outer winding ring with the strips preferably fastened to webs or ribs which, in turn, are fastened to encircling bands or rims. The coolant guidance can be optimized with this arrangement depending on the magnitude or dimension of the cross section for the cooling water through the perforated plates.

Moreover, in accordance with the invention, a seal is provided between the hollow shaft and the bottom of the coolant tank with the seal being monitored so that an early signal is provided when the seal of the hollow drive shaft for the winding disk is defective. When the seal is replaced in a timely manner, water can be prevented from breaking through with production losses being avoided. The indication of leakage can be afforded optically or acoustically by mechanical or electrical signal transmission.

It is particularly advisable in dry winding operation, that is, when the winding process is carried out without direct cooling of the material being wound, that the water level can be determined and adjusted as a function of the winding speed for cooling the basket winder. The cooling of the outer jacket, made up of the outer ring rods and perforated plate strips, is effected without the material being rolled coming into contact with the water by providing a suction effect from a water reservoir in the lower region of the tank with the water level being determined as a function of the winding speed. The construction of a circular water column during rotation of the basket winder is effected automatically in a suitable construction and arrangement of the outer ring of rods, the internal diameter of the tank and the water outlet openings.

An advantage of the invention during wet winding is that the rings of wound material up to high ring weights can be subjected to a uniform, adjustable heat treatment and an improvement in the quality of the material structure and of the material surface, since scaling or oxidation is stopped with the entrance of the material to be wound into the coolant without any impairment of the throughput capacity of the installation. Moreover, it is possible with the installation to wind the material in a dry or wet operation, as desired, without taking into account losses in the winding speed. Further, the installation is arranged so that the coolant can be drained or supplied instantaneously depending on the characteristics of the material. Particularly, a favorable supply of the coolant from above prevents the formation of water cones due to centrifugal forces and enables a particularly good swirling motion of the coolant when supplying fresh water. Finally, an effective lubrication between the lifting frame and the drive shaft is effectively provided and easily serviced.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
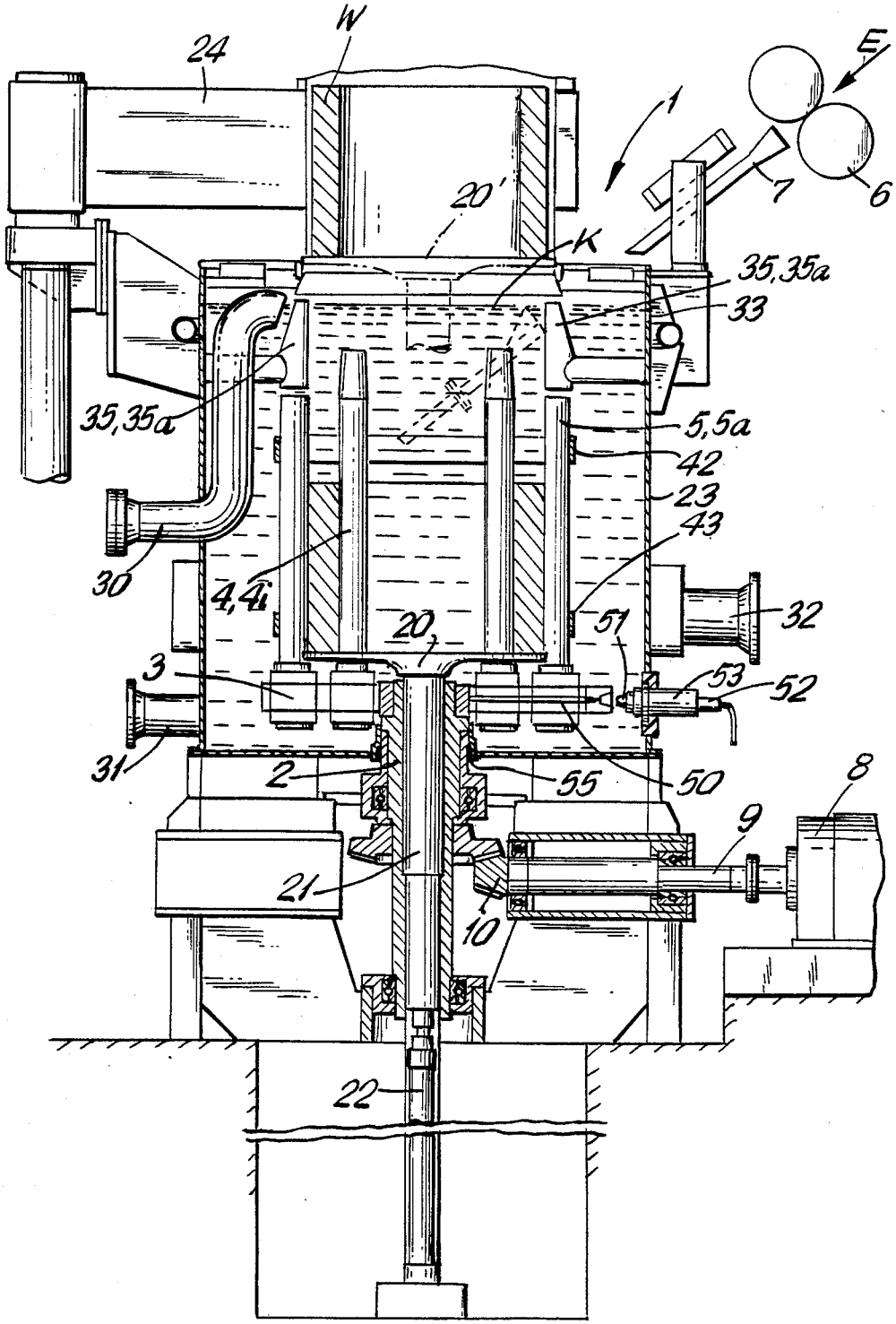
FIG. 1 is a schematic elevational view, partly in section, of a rotary basket winder embodying the present invention.
Figure 2:
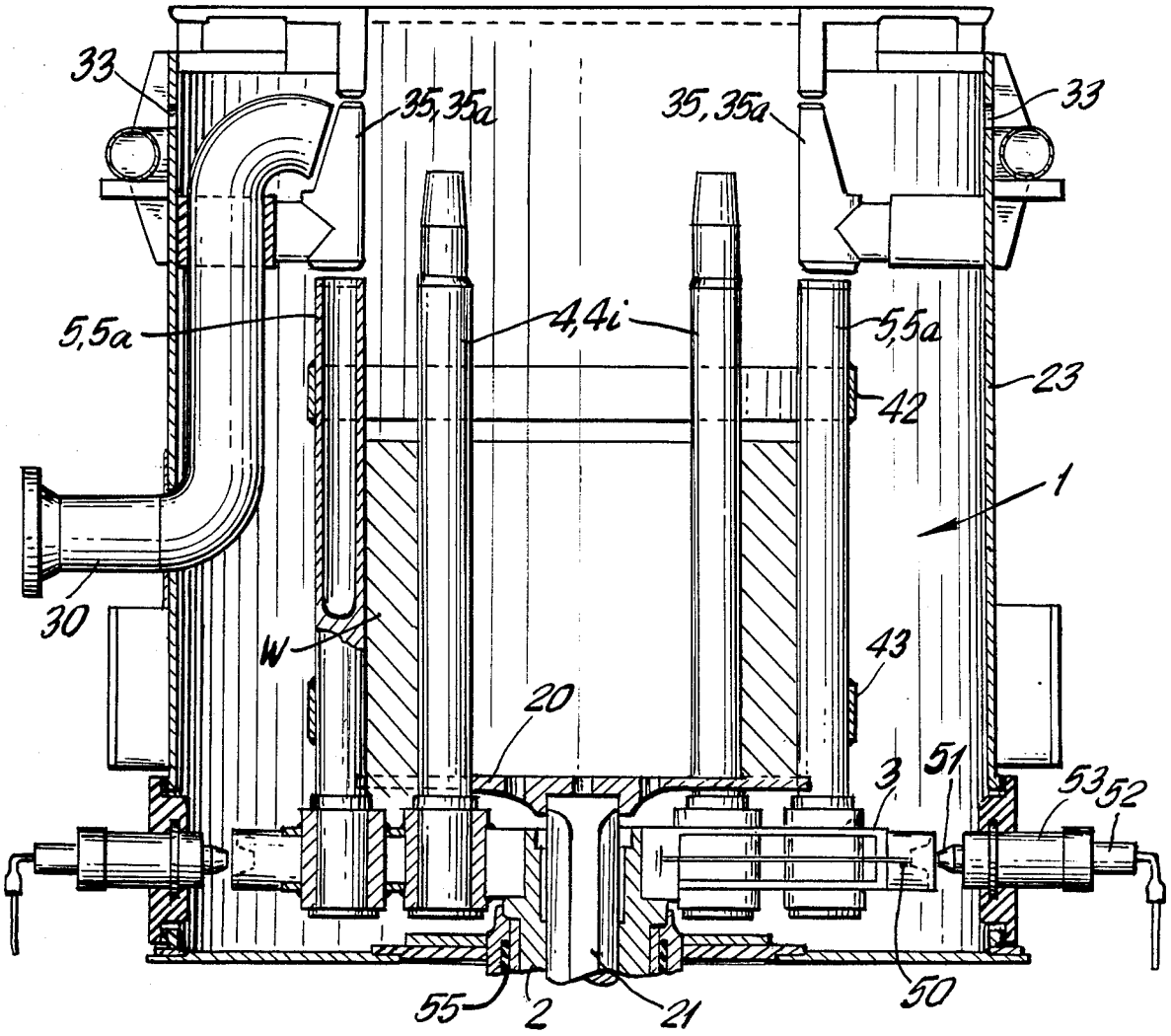
FIG. 2 is a sectional view of a rotary basket winder, enlarged as compared to FIG. 1.
Figure 3:
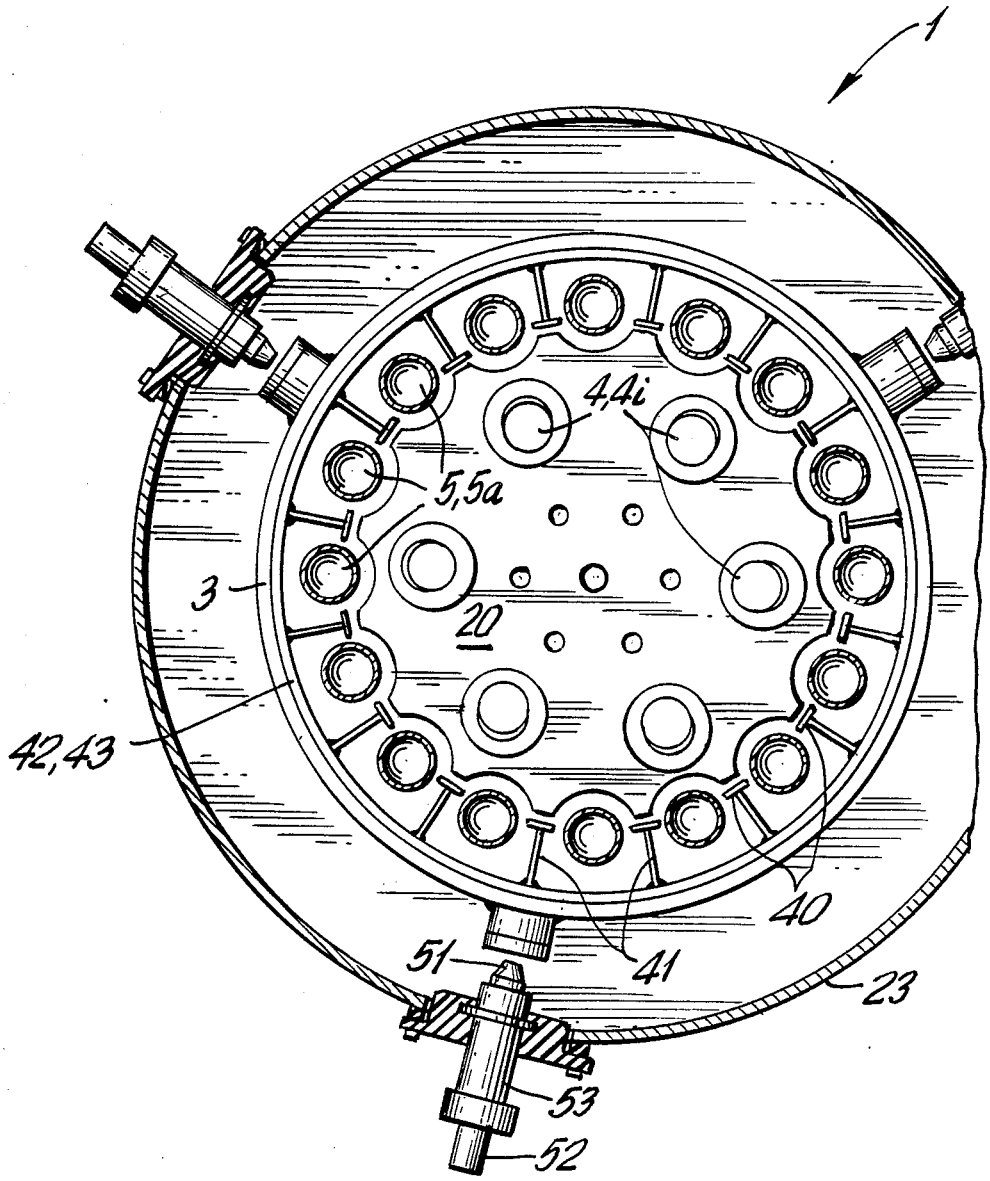
FIG. 3 is a sectional transverse view of the lower region of the rotary basket winder.

In FIGS. 1, 2 and 3, a Garrett winder or rotary basket winder 1 is displayed for use in so-called "dry winding" as well as "wet winding" of material to be wound where the material has a circular, flat, square or hexagonal cross section with a diameter in the range of approximately 6 mm to 50 mm. Rotary basket winder 1 in FIGS. 1 and 2, includes a winding rod carrier 3 driven by a vertically arranged hollow shaft 2. Winding rods 4, 5 are arranged in a wreath-like or ring shaped manner supported by the rod carrier 3. Winding rods 4, 5, also characterized as pins, form an inner ring **4*i*, and an outer ring 5*a*. A vertically extending annular space is located between the inner ring 4*i* and outer ring 5*a*** into which winding material W is introduced from above and where it is wound in a ring-shaped manner.

As shown in FIG. 1, material W to be wound is guided in a known manner diagonally downwardly from above the basket winder in the direction of the arrow E by a driving roller set 6, driven by a drive motor via an intermediate gear unit, not shown, with the material passing downwardly through a guidance tube 7, into the winding space between the rotating inner and outer rings **4*i*, 5*a* of the winding rods 4, 5. Within the winding space, the material W is wound into rings or a so-called coil. Hollow shaft 2 is driven by a drive motor 8 over a drive shaft 9 and a bevel gear unit 10 in meshed engagement with a corresponding bevel gear on the shaft. To afford a high throughput in wet winding, additional drive motors can be connected optionally to the hollow shaft 2** by corresponding drive shafts and bevel gear units, not shown.

A horizontally arranged lifting winding disk 20 is located between the inner and outer rings **4*i*, 5*a* of the winding rod carrier 3. Lifting disk 20 is connected with a hydraulic power device 22, such as a lifting cylinder, by way of a lifting rod linkage 21. By means of the lifting cylinder 22, a ring of material W, wound in the annular space between the rings 4*i*, 5*a* of winding rods, is lifted by the lifting rod linkage 21, so that the lifting disk can be displaced vertically from the position shown in full lines as characterized by reference numeral 20, into the position shown in dot-dashed lines characterized by the reference numeral 20'. The ring of material W is lifted vertically by means of the lifting cylinder 22 and the lifting rod linkage 21 and the lifting disk 20 out of the coolant tank 23 which is held stationary. In the upper position 20', the ring of material W is grasped by a swivel arm 24**, and pushed, by a swivel cylinder, into the region of another swivel arm, toward a ring conveyor and then is displaced to a ring collecting station, none of which are shown, at the end of the ring conveyor.

In so-called wet winding, a coolant K, such as water, is supplied into the coolant tank 23 through coolant supply lines 30, 31 via control valves, not shown, which can be actuated as required. For wet winding, tank 23 is filled with coolant K to a level above the ring height of the material W to be wound. Preferably, water is used as the coolant. To use the Garrett winder 1, without coolant K, for so-called dry winding of the material W, an outlet pipe 32 including an outlet valve, not shown, is provided in the lower region of the tank for emptying the tank. As can be noted in FIG. 1, coolant supply line 30 directs coolant into the upper region of the tank while coolant supply line 31 directs coolant into the lower region of the tank below the disk 20, as shown in its lower position within the tank. Accordingly, water can be supplied from above or below for improving the flow of the coolant K about the wound ring of material W.

In the upper region of the tank, exactly at the height of the desired coolant level, outlet openings 33 for the coolant are located in the tank wall with the outlet openings being dimensioned or adjustable so that a sufficient coolant K quantity is fed from above into the center of the inner ring **4*i*. As a result, coolant circulation is formed in the tank with a main flow extending substantially downwardly in the center of the tank and a corresponding main flow directed upwardly at the inner tank wall surface outside the outer ring, 5*a*. Rigid pins 35 are located in the upper region of the cooling tank 23 aligned above the rods 5 of the outer ring 5*a* forming a kind of extension of the rods 5. Pins 35 form a ring 35*a* with an inside diameter equal approximately to the inside diameter of the outer ring 5*a*. Preferably, pins 35 are arranged to be radially adjustable but are stationary relative to rotation of the rods. In an advantageous manner, rods 4 of the inner ring 4*i*, have a length or vertical height corresponding approximately to the desired level of the coolant K in the center of the inner ring 4*i*. As shown in FIG. 3, perforated plate strips 40 are located between the winding rods 5 of the outer ring 5*a* and are fastened to generally radially extending webs 41. The webs extend outwardly from the strips 40 and are secured to ring-like bindings 42, 43 welded with the winding rods 5 of the outer ring 5*a*. Note in FIG. 1, that the windings 42, 43 are spaced vertically apart. Lubrication of the guidance of the lifting rod linkage 21, note FIGS. 1 and 2, in the region of the hollow shaft 2, at the level of the winding rod carrier 3, is effected by lubricant channels 50 arranged radially in the carrier 3, via centering cones 51, which can be moved radially inwardly and outwardly by piston rods 52 actuated by hydraulic power means 53. In FIGS. 1 and 2, a seal for the drive shaft 2 of the winding disk 20 is shown with the drive shaft 2 being in the form of a hollow shaft. The seal is located at the point where the drive shaft 2 passes through the base or bottom of the coolant tank 23. The seal is formed by a combination of a grease-lubricated initial seal, a centrifugal disk for removing possible drop formation of the coolant K, and an oil-lubricated main seal, not shown. In addition, a seal 55 is provided between the hollow shaft 2 and the bottom of the coolant tank 23. In the event leakage occurs, seal 55 provides a signal that the main seal is defective at the location where the drive shaft 2 for the winding disk 20 passes through the bottom of the coolant tank 23. Such leakage detection is effected, for example, where leakage water drops are collected on a plate below the bottom of the tank 23**, and are guided outwardly through a pipeline, not shown. Repeated occurrence of leakage water is thus visible in a simple manner at a suitable location.

The present invention is not limited to the embodiment displayed in the drawing. For example, stationary pins in the upper region of the tank can be attached in a desired manner to the tank cover without departing form the framework of the invention.

While specific embodiments of the invention have been shown and described in detail to illustrate the application of the inventive principles, it will be understood that the invention may be embodied otherwise without departing from such principles.

We claim:

1. A rotary basket winder with cooling for winding material comprising a tank having an axial center and being in the shape of an open top tank with a closed bottom, means within said tank for rotating material to be wound around a generally vertical axis, said means comprising a horizontally arranged rotatable winding carrier located within said tank, a pair of concentrically arranged rings of upwardly extending rods supported at the lower ends thereof on said carrier end located within said tank including an inner ring spaced radially inwardly from an outer ring and forming therebetween an upwardly extending annular winding space for the material to be wound, a stationary guide pipe arranged for supplying material into the annular winding space, said means for rotating material includes a drive shaft extending upwardly through the bottom of said tank and arranged to rotate said winding carrier and rings, a horizontal winding disk having a lower position within said tank closely above said carrier and being displaceable upwardly to an upper position for removing wound material from the annular winding space, means for sealing said drive shaft in the bottom of said tank, means for supplying and effecting regulated flow of coolant in said tank, wherein the improvement comprises that said means for supplying and effecting regulated flow includes outlet openings in said tank adjacent the open top thereof, said outlet openings being arranged for conveying coolant from said tank back into the axial center of said tank at the upper end thereof, rigid pins are located in the upper region of said tank generally above and separate from said rods of said outer ring, said rigid pins form a ring having an inside diameter approximately equal to the inside diameter of said outer ring of winding rods, said pins are stationary relative to rotation of said inner and outer rings, said pins extend vertically in a laterally spaced relationship, said pins are radially adjustable relative to the axial center of said tank and said pins located opposite and inwardly from said outlet openings adjacent the open top of said tank.

2. Rotary basket winder, as set forth in claim 1, wherein said winding rods of said inner ring have a length corresponding approximately to a level of the coolant in the axial center of the inner ring.

3. Rotary basket winder, as set forth in claim 1, wherein perforated plate strips are located between said winding rods of said outer ring.

4. Rotary basket winder, as set forth in claim 3, wherein webs are secured to said perforated plate strips and extend outwardly therefrom and bindings extending circumferentially around said winding rods of said outer ring with said webs fastened to said bindings.

5. Rotary basket winder, as set forth in claim 1, wherein said sealing means comprises a seal located between said drive shaft and the bottom of said tank where said drive shaft extends through the bottom of said tank, and means for monitoring said seal.

6. Rotary basket winder, as set forth in claim 1, wherein said basket winder can be used for wet operation or dry operation, said tank being arranged during dry operation so that the cooling level can be determined and adjusted as a function of the winding speed for cooling the basket winder.

* * * * *